US006406002B1

(12) United States Patent
Hardy, III et al.

(10) Patent No.: US 6,406,002 B1
(45) Date of Patent: Jun. 18, 2002

(54) PORTABLE HANDRAIL SYSTEM

(75) Inventors: Frank Theodore Hardy, III, Littlerock; John Charles Firm, Palmdale, both of CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 25 days.

(21) Appl. No.: 09/592,754

(22) Filed: Jun. 13, 2000

(51) Int. Cl.[7] ..... E04H 17/00; E04H 17/22

(52) U.S. Cl. ..... 256/24; 256/64; 256/23; 256/DIG. 2

(58) Field of Search ..... 256/73, 24, 35, 256/25, 64, DIG. 2

(56) References Cited

U.S. PATENT DOCUMENTS

| | | | | | |
|---|---|---|---|---|---|
| 202,722 | A | * | 4/1878 | Harrington | 256/73 X |
| 2,932,510 | A | * | 4/1960 | Kravitz | 248/423 X |
| 3,578,372 | A | | 5/1971 | Schuler | |
| 3,602,543 | A | | 8/1971 | Sjodin | |
| 3,853,203 | A | | 12/1974 | Werner et al. | |
| 4,126,307 | A | | 11/1978 | Stevenson | |
| 4,234,112 | A | | 11/1980 | Gallant | |
| 4,465,262 | A | | 8/1984 | Itri et al. | |
| 4,645,183 | A | * | 2/1987 | Rattray et al. | 256/25 |
| 4,893,787 | A | * | 1/1990 | Watson | 256/35 |
| 4,921,373 | A | | 5/1990 | Coffey | |
| 4,951,911 | A | * | 8/1990 | Zatopek | 248/362 |
| 5,180,143 | A | * | 1/1993 | Brower | 256/24 |

* cited by examiner

*Primary Examiner*—Lynne H. Browne
*Assistant Examiner*—Ernesto Garcia
(74) *Attorney, Agent, or Firm*—Stetina Brunda Garred & Brucker

(57) ABSTRACT

A stable portable handrail system able to withstand significant weight and stress through sound securement of surface-engaging components thereof. The system first includes a plurality of spaced-apart vertical members each having at a base a pivoting vacuum cup assembly for vacuum engagement with a substantially horizontal surface upon which the handrail system is to be accommodated. At least one horizontal member is connected to each vertical member, and at least one brace member extends in outrigger fashion to the horizontal surface at an angle with respect to the vertical members. The base of the brace member likewise is a pivoting vacuum cup assembly for vacuum engagement with the horizontal surface. Preferably, all vacuum cup assemblies include respective valves for external application of a vacuum source for stable system vacuum securement throughout the term of use of the handrail system. Brace orientation at an angle between about 30° and 60° contributes significant load bearing attachment and resulting stability and safety to this portable handrail system.

18 Claims, 2 Drawing Sheets

PORTABLE HANDRAIL SYSTEM

STATEMENT OF GOVERNMENT RIGHTS

This invention was made with Government support under contract F33657-87-C-2000 awarded by the United States Air Force. The Government has certain rights in this invention.

CROSS-REFERENCE TO RELATED APPLICATIONS (Not Applicable)

STATEMENT RE: FEDERALLY SPONSORED RESEARCH/DEVELOPMENT (Not Applicable)

1. Field of the Invention

The present invention relates in general to portable railings and fencing, and in particular to a portable handrail system wherein vertical members and angular brace members each have as bases therefor a vacuum cup for vacuum engagement with a substantially horizontal surface.

2. Background of the Invention

Both the performance of certain tasks as well as the mere walking from one location to another many times can require, or certainly benefit from, strategically placed handrails for personal engagement while completing activity. Generally, where an ongoing need for a railing is present, a permanent structure is provided and, because of such permanency, is usually installed according to safety standards that assure adequate weight and impact pressures. In addition to such ongoing requirements, however, are temporary requirements for such protective railings because of special workplaces, event, or the like. Thus, for example, a particular work site situated in a potentially hazardous setting may be in need of repair, and in order to complete such repair, a worker may need a stabilizing handrail to ensure non-injury during work performance. In like manner, a special event such as a ball game in a park or a traveling circus in a shopping center parking lot may require special handrails placed in strategic locations such that guests and participants can safely walk within the grounds. In either exemplified situation, however, the construction of a permanent railing is not a practical option.

In order to satisfy the need for portable handrail protection, certain portable structures have been made available for placement at relevant sites. Such structures can include a telescoping fence that can be mechanically clamped to an existing permanent fixture, a length of railing mounted on spaced standards whose respective bases are T-shaped to maintain an upright position and resulting horizontal railing, a railing having a horizontal component for temporary engagement with a nearby permanent vertical wall, and like approaches for transient engagement. While such apparatus may provide at least a modicum of safety in various placements, certain other applications require a handrail stability equivalent to a permanent installation, yet sufficiently portable to be easily and quickly assembled, and just as easily removed when no longer needed.

In view of such a requirement, it is apparent that a need is present for a handrail system that is able to withstand heavy strain, stress, and tension, yet having complete portability without need for any ancillary fixtures at a site of use. Accordingly, a primary object of the present invention is to provide a portable handrail system wherein both vertical and bracing members thereof require only a single generally horizontal site to accomplish significant load bearing attachment and resulting stability and safety.

Another object of the present invention is to provide a portable handrail system having a plurality of vertical post members and angular brace members all having as their respective bases vacuum cups for vacuum engagement with a horizontal surface upon which the portable system is to be mounted.

Yet another object of the present invention is to provide a portable handrail system having one or more horizontal members extending between the vertical post members and, where a plurality are employed, vertically spaced from each other to produce railing efficiency at different heights above the horizontal surface.

These and other objects of the present invention will become apparent throughout the description thereof which now follows.

SUMMARY OF THE INVENTION

The present invention is a stable portable handrail system able to withstand significant weight and stress through sound securement of surface-engaging components thereof. The system first includes a plurality of spaced-apart vertical members each having at a base a vacuum cup assembly having a vacuum cup for vacuum engagement with a substantially horizontal surface upon which the handrail system is to be accommodated. At least one horizontal member is connected to each vertical member, and at least one brace member extends to the-horizontal surface at an angle with respect to the vertical members. As with the vertical members, the base of the at least one brace member is a vacuum cup assembly having a vacuum cup for vacuum engagement with the horizontal surface. The vacuum cup assemblies preferably pivot to allow variability in perpendicular placement of the handrail system and especially to permit angular variation of a brace member such that the brace member functions as an outrigger in providing sideways stability for the entire handrail system.

A preferred handrail system encompasses a plurality of horizontal members spaced vertically from each other to thereby create a number of horizontal members each at a different height, while a plurality of brace members angularly extend between about 30° and 60°, preferably 45°, to the horizontal surface. Preferably, the vacuum cups of both the vertical members and the brace members have respective valves leading for external application of a vacuum source to thereby further ensure maintenance of stable system securement throughout the term of use of the handrail system. As is evident, when the system is no longer needed at its site, the vacuum cups of both the vertical and brace members are separated from the horizontal surface and the entire system is disassembled for subsequent reassembly at a different location. In this manner, a safe handrail installation can be provided where temporarily needed and thereafter easily removed for deployment to another post.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
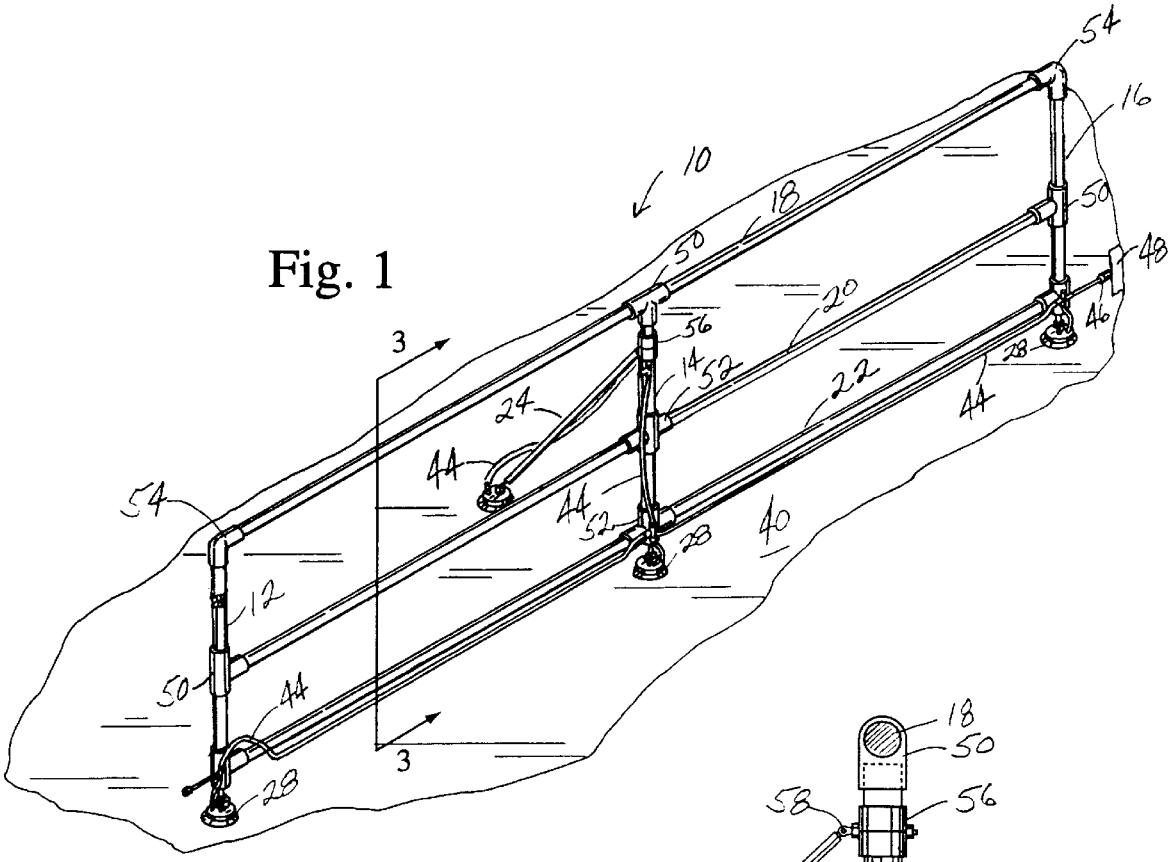
FIG. 1 is a perspective view of a portable handrail system.
Figure 3:
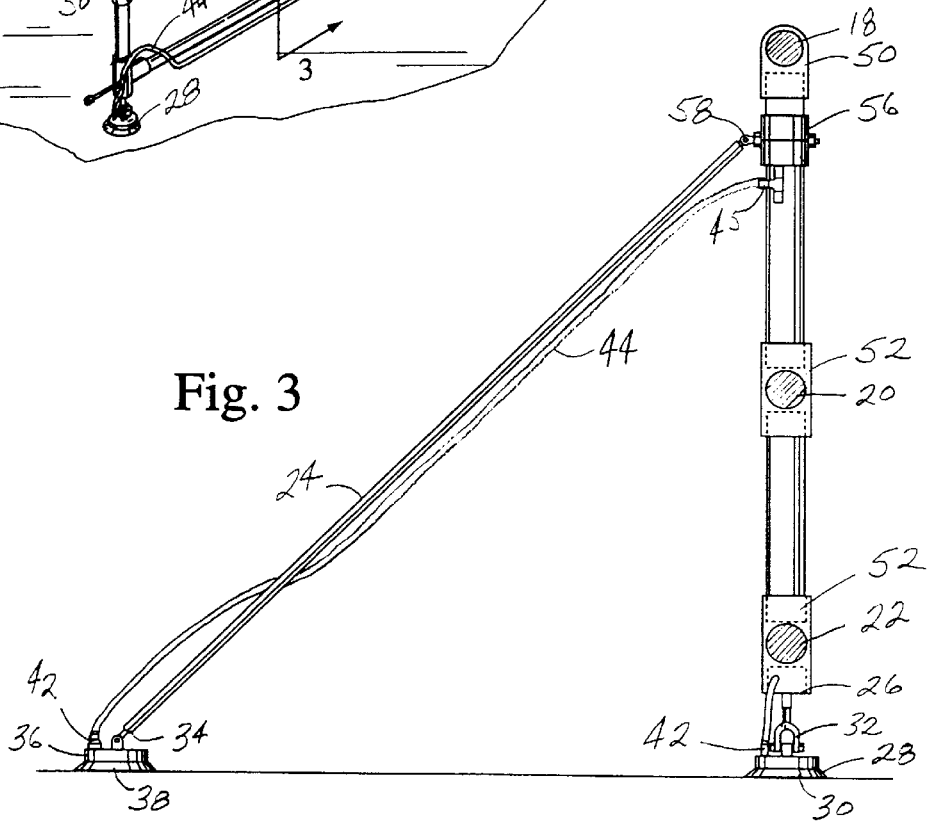
FIG. 3 is an elevation view in section along line 3—3 of FIG. 1.
Figure 2:
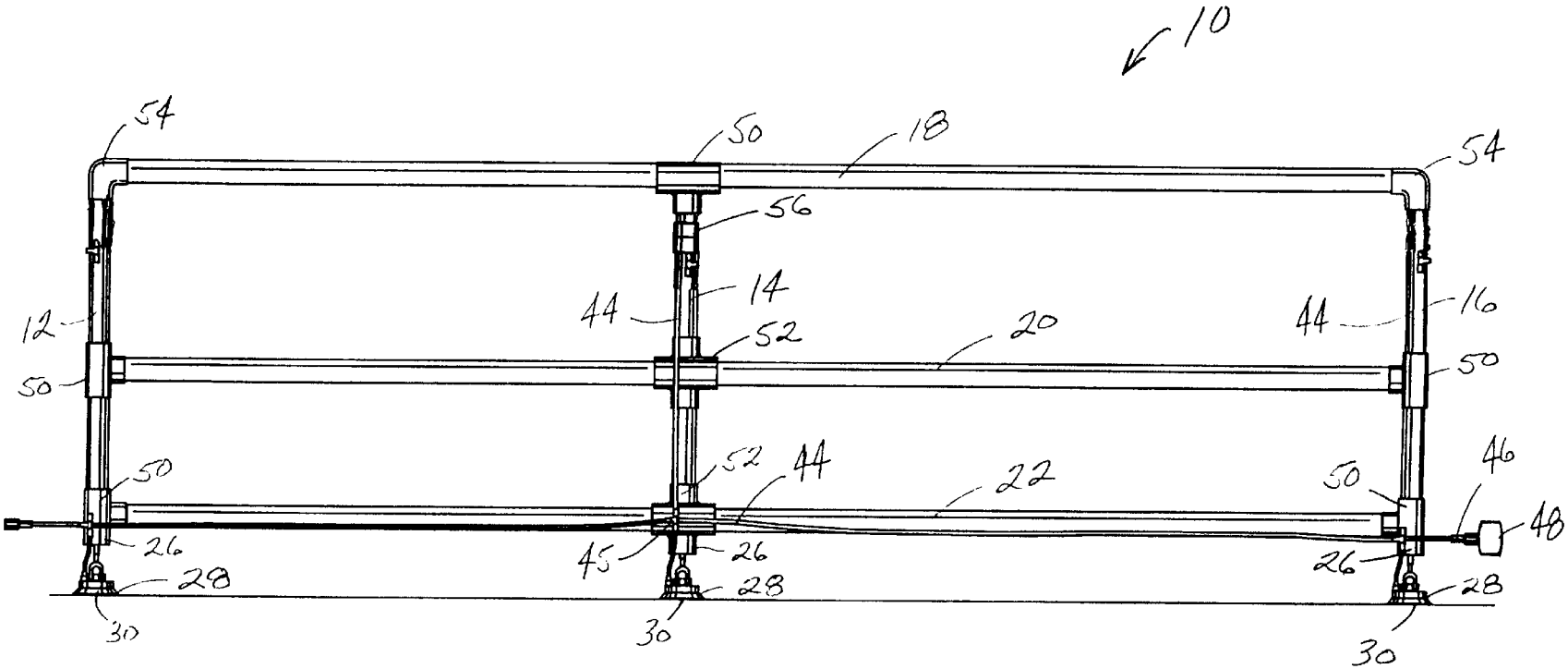
FIG. 2 is a side elevation view of the portable handrail system of FIG. 2.

Referring to FIGS. 1–3, a portable handrail system 10 having three spaced-apart vertical members 12, 14, 16, three spaced-apart horizontal members 18, 20, 22, and one brace member 24. Vertical members 12, 14, 16 and horizontal members 18, 20, 22 are preferably constructed of polyvinyl chloride, while the brace member 24 is preferably constructed of square steel tubing. The respective bases 26 of the vertical members 12, 14, 16 have respective vacuum cup assemblies 28 each having a vacuum cup 30 pivotally mounted on a conventional yoke 32 to thereby permit pivotal movement of each assembly 28 over an arc. In like manner, the base 34 of the brace member 24 has a vacuum cup assembly 36 having a vacuum cup 38 also pivotally mounted for pivotal movement in the same manner as that provided to the vacuum cup assembly 28 of each vertical member 12, 14, 16.

The vacuum cups 30, 38 are engageable with a generally horizontal surface 40 to thereby secure respective bases of both the vertical members 12, 14, 16 and brace member 24. As is thus evident, such surface 40 must be able to accept and maintain vacuum cup engagement. Each cup 30, 38 is provided with a respective standard stemmed valve 42 leading from an interior of a cup 30, 38 to a tube network 44 with appropriately placed branch connectors 45 and whose proximal end 46 is connectable to a conventional vacuum source 48 whose operation creates enhanced positive vacuum adherence of the cups 30, 38 when already in suctional contact with the horizontal surface 40. As is of course apparent, where a tube network 44 is not present, individual valves 42 of individual surface-suctionized cups 30, 38 can be placed in contact with a vacuum source 48 to achieve enhanced vacuum production and resulting enhanced surface securement.

As illustrated in FIGS. 1 and 2, the vertical members 12, 14, 16 and horizontal members 18, 20, 22 are screw-thread connected by interior-threaded T-shape, cross, and elbow connectors 50, 52, 54 to each other. In particular, the elbow connectors 54 join the top horizontal member 18 at each end thereof to respective tops of the terminating vertical members 12, 16, while T-shape connectors 50 connect the lower horizontal members 20, 22 to the terminating vertical members 12, 16 and the top horizontal member 18 to a non-terminating vertical member 14. Finally, cross connectors 52 secure lower horizontal members 20, 22 to a non-terminating vertical member 14. As is illustrated in the drawing figures, each vertical (12, 14, 16) and horizontal (18, 20, 22) member in the preferred embodiment actually is constructed of multiple sections that, upon connection through a cross connector 52, ultimately become a completed vertical (12, 14, 16) or horizontal (18, 20, 22) member.

Bracing support is accomplished by the angularly disposed brace member 24 extending in outrigger fashion from the center vertical member 14 to the horizontal surface 40 at an angle between about 30° and 60°, most preferably 45°, as measured from the vertical member 14. A sleeve member 56 is disposed at the top of the vertical member 14 and is provided with a standard pivot pin 58 for pivotal engagement of the top 56 of the brace member 24 with the vertical member 14 as shown in FIG. 3. As also shown in both FIGS. 1 and 3, each sleeve member 52 is fitted with a vacuum network connector 45 for connection with the tube network 44 as earlier described. As with the vacuum cups 30 of the vertical members 12, 14, 16, the vacuum cup 38 of the brace member 24 is suctionally engageable with the horizontal surface 40 and, after such engagement, can have a vacuum source 48 applied thereto as earlier described to thereby enhance securement of the brace member 24 with the horizontal surface 40. Although the handrail system 10 here illustrated is relatively short and therefore has only a single non-terminating vertical member 14 from which a single brace member 24 extends, it is to be understood that a longer handrail system is constructed to extend over a longer length by employing a greater number of spaced vertical members connected to horizontal members that extend the desired length. When such is the case, more brace members 24 are provided, and most preferably are provided such that each non-terminating vertical member is provided with such brace member 24. Additionally, and not here shown, the terminating vertical members (e.g. 12, 16) also can be provided with respective brace members 24 as desired for stability of the handrail system.

In operation, the handrail system here described is easily assembled and installed at a site whose horizontal or base surface has sufficient non-porosity, such as exemplified by sealed wood, concrete, painted substrate, etc., to permit vacuum cup engagement. Specifically, an installer first conventionally assembles the horizontal and vertical members employing appropriate connectors as described above, and thereafter attaches the top of each brace member to an upper site of one or more vertical members as determined to be necessary by the installer in relation to stability required for a particular installation. The assembled handrail system with angled brace member(s) then is positioned at its designated site on a cooperating horizontal surface and the brace member(s) are stationed for stable leverage. All vacuum cups are manually positioned for suction securement, and the vacuum source is thereafter applied to the vacuum cups for enhanced suction adhesion to the horizontal surface to thereby provide temporary handrail placement where needed. Because of the capability to receive vacuum source applications, the installer can re-apply the vacuum source to the vacuum cups from time to time and thereby conveniently maintain effective suction adhesion of the system. When the handrail system is no longer required at its designated site, the installer simply opens the valves to the vacuum cups to release vacuum adherence and thereafter disassembles the system for re-positioning later.

It is therefore apparent that the present invention provides significant load bearing attachment with resulting stability, safety, and system securement. While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A portable handrail system comprising:

a) a plurality of spaced-apart vertical members each having at a base a vacuum cup assembly comprising a vacuum cup for vacuum engagement with a substantially horizontal surface upon which the handrail system is to be accommodated;

b) at least one horizontal member connected to each vertical member; and c) at least one brace member extending at an angle with respect to the vertical members to the horizontal surface and having at a base a vacuum cup assembly comprising a vacuum cup for vacuum engagement with said substantially horizontal surface;

d) wherein the vacuum cup assembly of each vertical member is pivotable.

2. A portable handrail system as claimed in claim 1 wherein the vacuum cup assembly of the at least one brace member is pivotable.

3. A portable handrail system as claimed in claim 1 wherein the angle of the brace member is between about 30° and about 60°.

4. A portable handrail system as claimed in claim 1 wherein each vacuum cup assembly of the vertical members and the at least one brace member has a valve leading therefrom for external application of a vacuum source.

5. A portable handrail system as claimed in claim 1 wherein each vacuum cup of the vertical members has a diameter of about four inches.

6. A portable handrail system as claimed in claim 1 wherein the vacuum cup of the at least one brace member has a diameter of about 10 inches.

7. A portable handrail system as claimed in claim 1 wherein the vertical members and the at least one horizontal member are constructed of polyvinyl chloride tubing.

8. A portable handrail system as claimed in claim wherein the at least one brace member is constructed of square steel tubing.

9. A portable handrail system comprising:

a) a plurality of spaced-apart vertical members each having at a base a vacuum cup assembly comprising a vacuum cup for vacuum engagement with a substantially horizontal surface upon which the handrail system is to be accommodated;

b) at least one horizontal member connected to each vertical member;

c) at least one brace member extending at an angle with respect to the vertical members to the horizontal surface and having at a base a vacuum cup assembly comprising a vacuum cup for vacuum engagement with said substantially horizontal surface; and d) a central vacuum source engaged to each vacuum cup assembly via a tube network.

10. A portable handrail system as claimed in claim 9 wherein the vacuum cup assembly of each vertical member is pivotable.

11. A portable handrail system as claimed in claim 10 wherein the vacuum cup assembly of the at least one brace member is pivotable.

12. A portable handrail system as claimed in claim 9 wherein the vacuum cup assembly of the at least one brace member is pivotable.

13. A portable handrail system as claimed in claim 9 wherein the angle of the brace member is between about 30 degrees and 60 degrees.

14. A portable handrail system as claimed in claim 9 wherein each vacuum cup assembly of the vertical members and the at least one brace member has a valve leading therefrom for external application of a vacuum source.

15. A portable handrail system as claimed in claim 9 wherein each vacuum cup of the vertical members has a diameter of about four inches.

16. A portable handrail system as claimed in claim 9 wherein the vacuum cup of the at least one brace member has a diameter of about 10 inches.

17. A portable handrail system as claimed in claim 9 wherein the vertical members and the at least one horizontal member are constructed of polyvinyl chloride tubing.

18. A portable handrail system as claimed in claim 9 wherein the at least one brace member is constructed of square steel tubing.

* * * * *